United States Patent [19]

Keller

[11] Patent Number: 5,029,417

[45] Date of Patent: Jul. 9, 1991

[54] EDGE FINISHING TOOL

[76] Inventor: George Keller, P.O. Box 281, Kingman, Ariz. 86402

[21] Appl. No.: 519,823

[22] Filed: May 7, 1990

[51] Int. Cl.[5] ..... B24B 3/54

[52] U.S. Cl. ..... 51/181 R; 51/208; 76/82; 76/85; 76/86

[58] Field of Search ..... 51/208 R, 211 R, 354, 51/210 R, 181 R; 76/82, 86, 87, 88, 84, 85

[56] References Cited

U.S. PATENT DOCUMENTS

| | | | |
|---|---|---|---|
| 1,015,148 | 1/1912 | Dearborn | 76/87 |
| 1,458,938 | 6/1923 | Heyman | 76/87 |
| 1,516,997 | 11/1924 | Watts | 76/87 |
| 2,404,025 | 7/1946 | Barnes | 76/86 |
| 2,446,909 | 8/1948 | Davis | 76/87 |
| 3,052,068 | 9/1962 | Burgess | 76/86 |
| 4,910,923 | 3/1990 | McCabe | 76/82 |

FOREIGN PATENT DOCUMENTS

| | | | |
|---|---|---|---|
| 0155914 | of 0000 | United Kingdom | 76/86 |
| 0258135 | 9/1926 | United Kingdom | 76/86 |

*Primary Examiner*—Robert A. Rose

*Attorney, Agent, or Firm*—Leon Gilden

[57] ABSTRACT

A tool apparatus wherein an elongate longitudinally aligned handle includes a plurality of rollers rotatably mounted coaxially spaced from the handle forwardly thereof. The rollers include deburring or cutting edges to remove roughness and smooth edge surfaces of brittle material such as metals, rigid polymerics, and the like. Modifications of the invention includes a first roller biased against a second roller utilizing a hinged lever arm pair mounting one roller relative to the other roller. Further modifications include conically tapered rollers each including an axis parallel relative to one another wherein a removable conical abrasive sheaths are securably mounted utilizing adhesive and the like onto a respective conical roller.

1 Claim, 4 Drawing Sheets

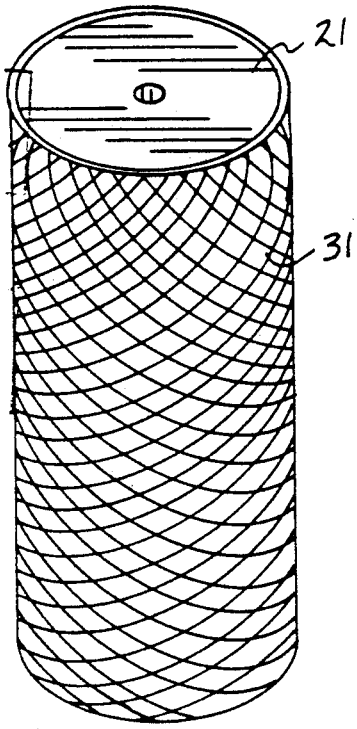
Fig 7
Fig 8
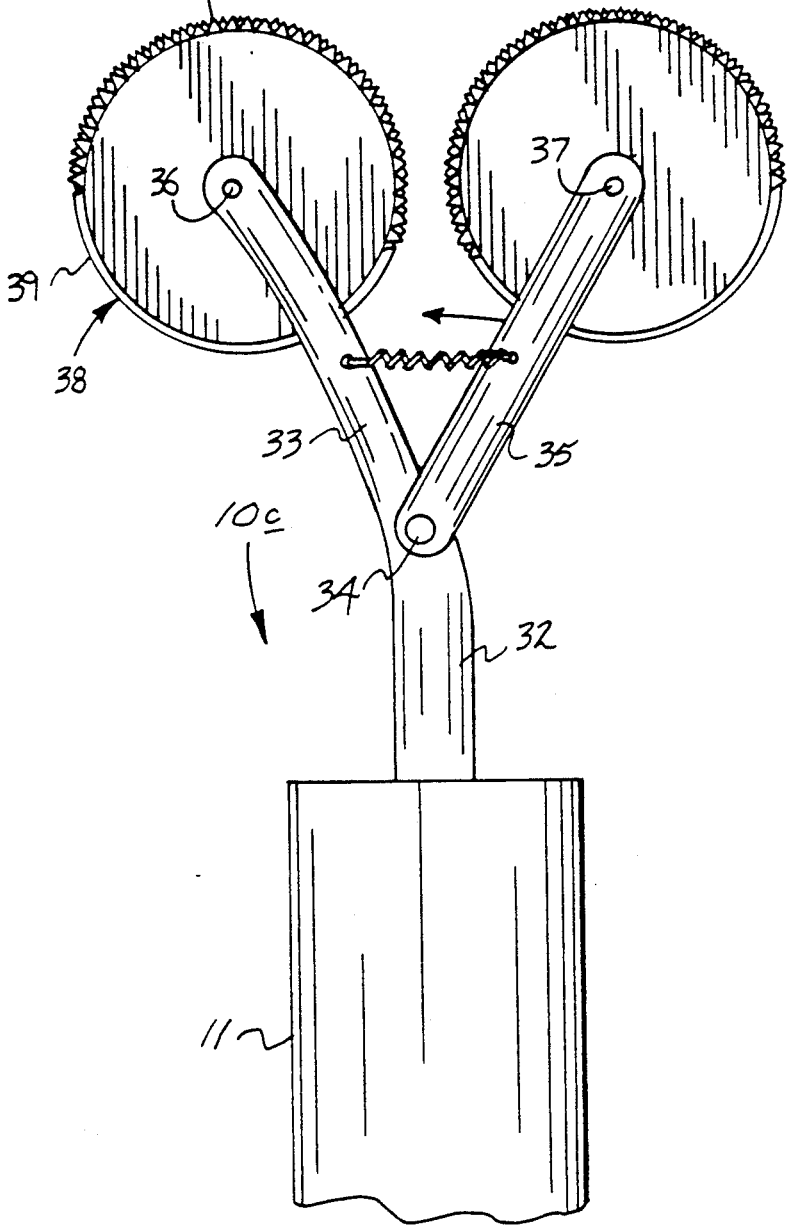

EDGE FINISHING TOOL

BACKGROUND OF THE INVENTION

1. Field of the Invention

The field of the invention relates to deburring tools, and more particularly pertains to a new and improved edge finishing tool wherein the same is arranged for removing roughness and smoothing edge portions of an associated rigid bodies.

2. Description of the Prior Art

The prior art has provided various tools for deburring and finishing various bodies formed of aluminum, steel, rigid polymerics, and the like. Typically these tools are in the form of files, rasps, or other similarly roughened planar surfaces to be directed across edge portions of various work pieces to remove projections and associated roughness in such work pieces.

The instant invention attempts to overcome deficiencies of the prior art by providing a readily transportable and manipulatable tool that may be rotatably directed across edge portions of an associated work piece to remove various roughness from such work piece. Prior art tool structure utilizing rotary tools may be found in U.S. Pat. No. 3,742,007 to GREEN utilizing a rotary powered trimming arrangement.

U.S. Pat. No. 4,178,747 to WILLIAMS utilizing a dual pair of cooperative rotors for trimming of various vegetation.

U.S. Pat. No. 2,525,944 to RALSTON to a plural rotary edging apparatus.

U.S. Pat. No. 4,691,784 to MULLET et al and U.S. Pat. No. 4,645,011 to FEIKEMA et al utilizing various herbage trimming apparatus.

Accordingly it may be appreciated that there remains a need for a new improved edge finishing tool as set forth by the instant invention which addresses both the problems of ease of use as well as effectiveness in organization and construction in permitting a direction of the tool across edge surfaces to be finished and in this respect, the present invention substantially fulfills this need.

SUMMARY OF THE INVENTION

In view of the foregoing disadvantages inherent in the known types of finishing tool structures present in the prior art, the present invention provides a new and improved edge finishing tool wherein the same utilizes a cooperating rotor member to direct a work piece therebetween to remove various surface roughness from such work pieces. As such, the general purpose of the present invention, which will be described subsequently in greater detail, is to provide a new and improved edge finishing tool which has all the advantages of the prior art finishing tool structure and none of the disadvantages.

To attain this, the edge finishing tool of the instant invention include a tool apparatus wherein an elongate longitudinally aligned handle includes a plurality of rollers rotatably mounted coaxially spaced from the handle forwardly thereof. The roller include deburring or cutting edges to remove roughness and smooth edge surfaces of brittle material such as metals, rigid polymerics, and the like. Modifications of the invention includes a first roller biased against a second rollar utilizing a hinged lever arm pair mounting one roller relative to the other roller. Further modifications include conically tapered rollers each including an axis parallel relative to one another wherein a removable conical abrasive sheaths are securably mounted utilizing adhesive and the like onto a respective conical roller.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved edge finishing tool which has all the advantages of the prior art edge finishing tools and none of the disadvantages.

It is another object of the present invention to provide a new and improved edge finishing tool which may be easily and sufficiently manufactured and marketed.

It is a further object of the present invention to provide a new and improved edge finishing tool which is of a durable and reliable construction.

An even further object of the present invention is to provide a new and improved edge finishing tool which is susceptible of a low cost of manufacture with regard to both materials an labor, and which accordingly is then susceptible of low prices of sale to the consuming public, thereby making such edge finishing tools economically available to the buying public.

Still yet another object of the present invention is to provide a new and improved edge finishing tool which provides in the apparatuses and methods of the prior art some of the advantages thereof, while simultaneously overcoming some of the disadvantages normally associated therewith.

Still another object of the present invention is to provide a new and improved edge finishing tool which may be compactly stored when not being utilized.

Yet another object of the present invention is to provide a new and improved edge finishing tool wherein the same utilizes a plurality of cooperating abrasive rollers to smooth and deburr a surface of an associated work piece.

These together with other objects of the invention, along with the various features of novelty which characterize the invention, are pointed out with particularity in the claims annexed to and forming a part of this disclosure.

For a better understanding of the invention, its operating advantages and the specific object attained by its uses, reference should be had to the accompanying drawings and descriptive matter in which there is illustrated preferred embodiments of the invention.

BRIEF DESCRIPTION OF THE DRAWINGS

The invention will be better understood and object other than those set forth above will become apparent when consideration is given to the following detailed description thereof. Such description makes referene to the annexed drawings wherein:

FIG. 7 is an isometric illustration of a modified abrasive roller utilized by the instant invention.

FIG. 8 is an orthographic side view taken in elevation of a yet further modified roller structure utilized by the instant invention.

DESCRIPTION OF THE PREFERRED EMBODIMENT

Figure 1:
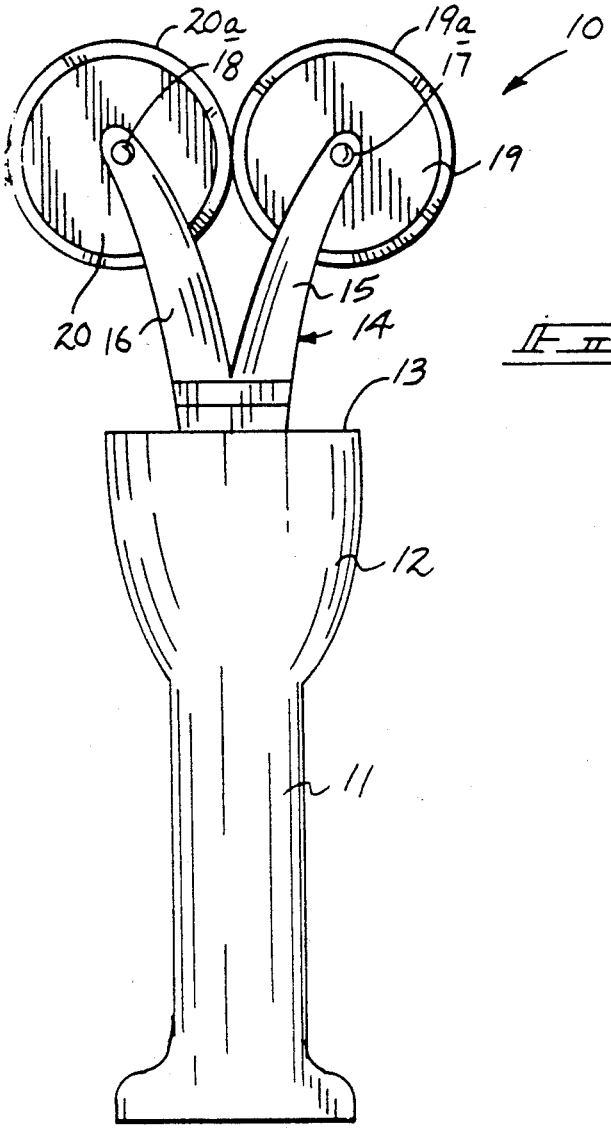
FIG. 1 is an orthographic view of the instant invention taken in elevation.
Figure 2:
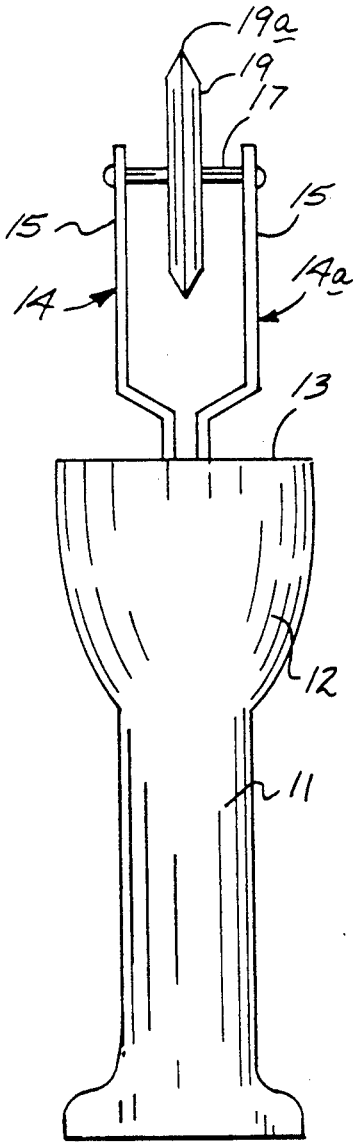
FIG. 2 is an orthographic end view of the instant invention taken in elevation.

With reference now to the drawings, and in particular to FIGS. 1 to 8 thereof, a new and improved edge finishing tool embodying the principles and concepts of the present invention and generally designated by the reference numerals 10, 10*a*, 10*b*, and 10*c* will be described.

More specifically, the edge finishing tool 10 of the instant invention comprises, elongate longitudinally aligned handle 11 mounting a support base 12 at a forward end of the handle 11 wherein the handle and support base are longitudinally aligned relative to one another. A planar top surface 13 defines the upper end of the support base 12 wherein the top surface 13 is arranged orthogonally relative to the handle 11. A first bifurcated support 14 is spaced from parallel to a second bifurcated support 14*a* each orthogonally mounted to the top surface 13. The first and second bifurcated supports each include a first and second leg 15 and 16 splayed outwardly relative to one another and including a first axle 17 directed orthogonally through the first legs 15 with a second axle 18 directed orthogonally through the second legs 16 wherein the first and second axles are parallel relative to one another and spaced an equal distance above the top surface 13. A first cylinder 19 is rotatably mounted about the first axle 17 with a second cylinder 20 rotatably mounted about the second axle 18. Each respective first and second cylinder includes a respective first and second annular edge 19*a* and 20*a*.

Figure 3:
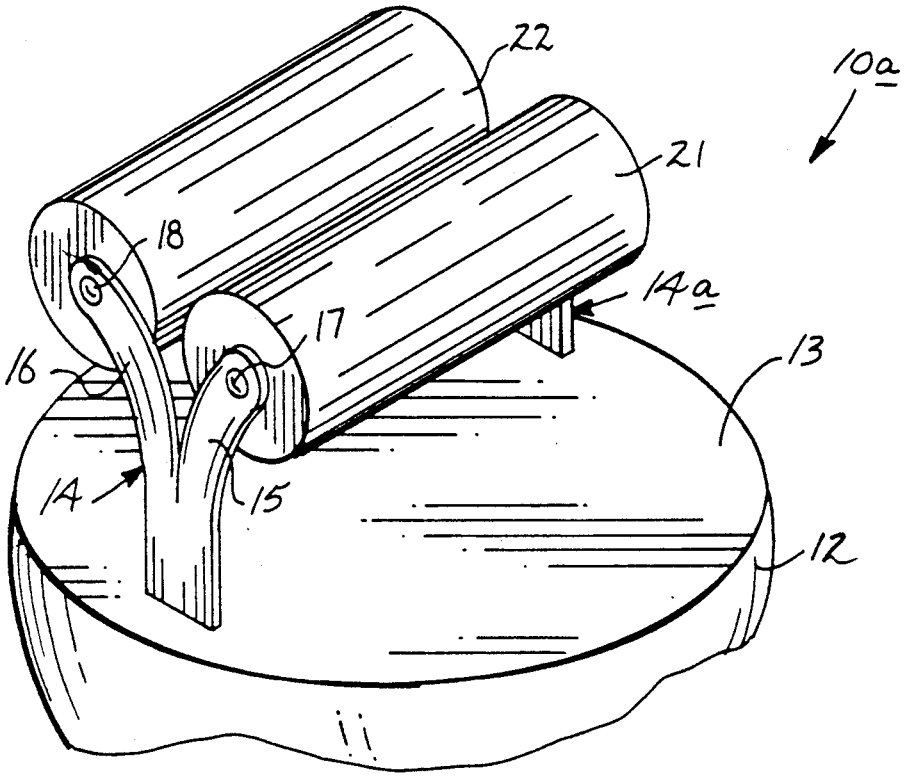
FIG 3 is an isometric illustration of a further example of the instant invention.

Reference to FIG. 3 illustrates a modified tool 10*a* utilizing a first abrasive cylinder 21 mounted to the first axle 17 with a second abrasive cylinder 22 mounted to the second axle wherein the first and second abrasive cylinders are longitudinally aligned and arranged parallel relative to one another and substantially coextensive with a diameter defined by the top surface 13.

Figure 4:
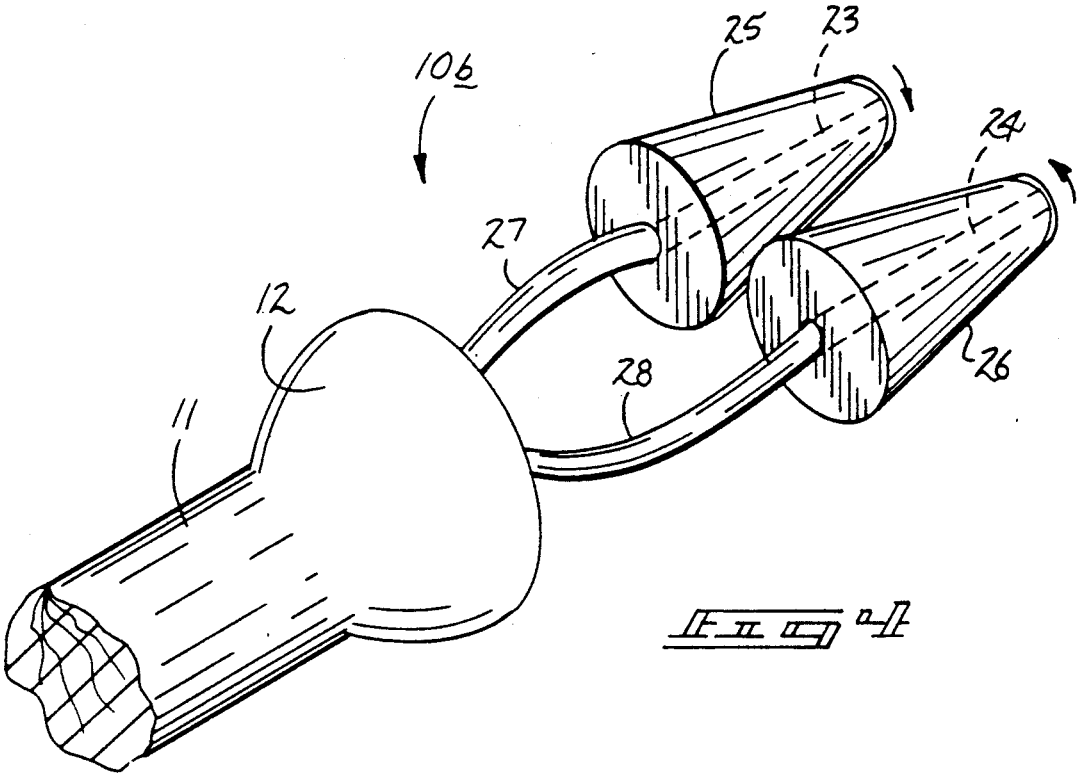
FIG. 4 is an isometric illustration of a yet further example of the instant invention
Figures 5, 6:
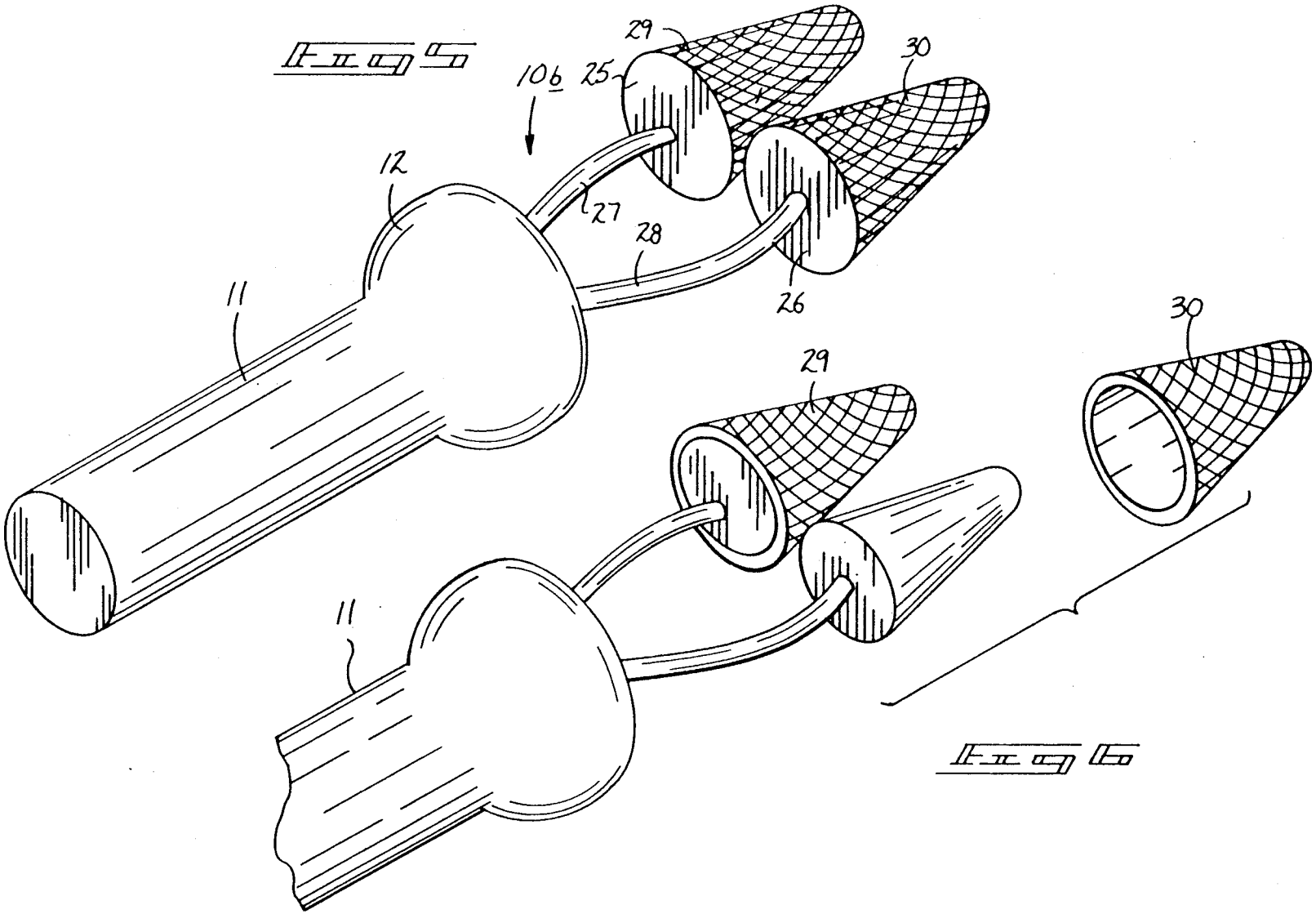
FIG. 5 is an isometric illustration of the invention in FIG. 4 illustrating the use of conical sleeves mounted thereon.
FIG. 6 is an isometric illustration of the invention as set forth in FIGS. 4 and 5 illustrating a sleeve spaced for securement to an associated conical roller.

FIG. 4 illustrates a further modified tool 10*b* utilizing a first and second support axle 23 and 24 arranged parallel relative to one another and defined as forward terminal ends of respective first and second support legs 27 and 28 directed forwardly of the top surface 13. A first rotatable conical abrasive member 25 is mounted about the first support axle 23 and a second rotatable conical abrasive member 26 is rotatably mounted about the second support axle 24 to accommodate work pieces of various configuration directed therebetween. The first conical abrasive member 25 and the second conical abrasive member 26 respectively receive first and a second abrasive conical sleeves 29 and 30 replacably thereon (see FIG. 5 and 6). The conical sleeves 29 and 30 may be adhesively mounted about the exterior surface of each of the abrasive members 25 to provide abrasive surfaces of various coarseness and operating capacity.

FIG. 7 illustrates the use of a file type cutting surface 31 mounted coextensively about the exterior cylindrical surface of the first abrasive cylinder 21 wherein it is understood that the second abrasive cylinder 22 may be formed of a similar surface finishing to effect operating of various work pieces to effect a finished surface of a desired smoothness.

FIG. 8 illustrates a yet further modified tool organization 10*c* wherein a single support leg 32 is orthogonally mounted to the top surface 13 relative to the handle 11 and the support leg 32 includes an upper end portion 33 angularly and integrally mounted relative to the support leg 32 with a pivot 34 mounted at the intersection of the upper end portion 33 relative to the support leg 32. A pivot leg 35 is mounted to the pivot 34 at one end and includes a second axle 37 directed therethrough cooperative with a first axle 36 mounted adjacent an upper terminal end of the upper end portion 33. In a manner as set forth in FIG. 3 for example, spaced parallel support legs 32 and associated structure is provided to support the first and second axles 36 and 37 parallel and relative to one another. Each of the support axles include an associated edging drum 38 defined by a semi-cylindrical smooth finishing surface 39 diametrically opposed to a semi-annular rasp surface 40 to effect a multiple operating pattern of the tool in use about a work piece.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimenional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. An edge finishing tool comprising, an elongate handle including a support base, the support base and the handle longitudinally aligned relative to one another, the support base including a planar top surface, the planar top surface orthogonally aligned relative to the handle and support base, and a first support integrally mounted to the top surface and spaced from and parallel to a second support integrally mounted to the top surface, and roller means extending unshrouded and beyond the top surface rotatably mounted to the first and second support wherein the roller means includes an abrasive surface for operating an edge portion of an associated work piece, and wherein the first support includes a first support leg, and the second support includes a second support leg, the first support leg including a first axle mounted to a forward terminal end of the first support leg, and the second support leg includes a second axle mounted at a forward terminal end of the second support leg, wherein the first axle and the second axle are arranged parallel relative to one another, and the first axle rotatably mounts a first conical member thereabout, and the second axle rotatably mounts a second conical axle thereabout wherein the first and second axles are each defined by a predetermined length, and wherein the first conical member includes a removable conical sheath formed coextensively about a first conical surface defined by the first conical member, and the second conical member includes a second conical sheath mounted about the second conical member, and wherein the first conical sheath and the second conical sheath are each formed of an abrasive textured exterior surface member, and each first and second conical sheath is adhesively secured to respective first and second conical members to enhance ease of removal from the respective first and second conical members.

* * * * *